US005118011A

United States Patent [19]

Kopp

[11] Patent Number: 5,118,011

[45] Date of Patent: Jun. 2, 1992

[54] FOOD ROLLER DISPENSER

[75] Inventor: Raun A. Kopp, Brunswick, Ohio

[73] Assignee: Oatey Co., Cleveland, Ohio

[21] Appl. No.: 622,510

[22] Filed: Dec. 5, 1990

[51] Int. Cl.[5] ..... B65D 35/28

[52] U.S. Cl. ..... 222/102; 222/105; 222/181

[58] Field of Search ..... 222/98, 101-105, 222/148, 181, 93; 251/4, 6, 10

[56] References Cited

U.S. PATENT DOCUMENTS

| | | | |
|---|---|---|---|
| 1,783,101 | 11/1930 | Schaefer | 222/102 |
| 2,037,138 | 4/1936 | McConnon | 222/102 |
| 2,567,767 | 9/1951 | Ditmanson | 222/102 |
| 2,734,662 | 2/1956 | Shippen | 222/105 |
| 4,213,542 | 7/1980 | Wilson | 222/102 |
| 4,287,921 | 9/1981 | Sanford | 222/181 |
| 4,354,623 | 10/1982 | Gill et al. | 222/102 |
| 4,627,551 | 12/1986 | Kopp | 222/107 |

*Primary Examiner*—Michael S. Huppert
*Assistant Examiner*—Philipee Derakshani
*Attorney, Agent, or Firm*—Renner, Otto, Boisselle & Sklar

[57] ABSTRACT

A food roller dispenser for dispensing the contents from a flexible pouch-like food container by passing the container between a pair of elongate rollers having teeth which mesh and overlap each other to drivingly grip the container between the meshed teeth and squeeze the contents from the container during counter-rotation of the rollers. Each of the rollers is of a solid one-piece plastic construction having roller bearing portions adjacent opposite ends which are removably captured in easily disassembled bearing blocks for ease of cleaning. One of the rollers is driven by a handcrank which, through a set of gears mounted on shaft extensions on the ends of the rollers, drives the other roller in the opposite direction.

12 Claims, 5 Drawing Sheets

FOOD ROLLER DISPENSER

TECHNICAL FIELD OF THE INVENTION

This invention relates generally, as indicated, to a food roller dispenser for dispensing food from flexible food pouches and similar type containers.

BACKGROUND OF THE INVENTION

Many food products such as toppings and other ingredients used in preparing foods commercially are prepackaged in flexible containers or pouches to reduce packaging costs as well as shipment and storage costs and for ease of handling and use of the food products. These flexible containers or pouches are usually designed so that one corner or end of the containers can be cut off and the contents squeezed out. Normally the flexible containers are hand squeezed, making it virtually impossible to remove the entire contents, resulting in some waste of the food product.

Squeeze roller dispensers of various types have been utilized in the past. One type of dispenser that has been used effectively for dispensing putty-like material from a flexible bag-like container is disclosed in U.S. Pat. No. 4,627,551, which is assigned to the same assignee as the present application. An objection to using this type of dispenser for dispensing food products is that the rollers are provided with rubber-like covers which are not acceptable for use in the food industry for sanitation reasons. Some materials that are suitable for use in industries in which sanitation is not a major concern may be sanitarily unsuitable for use in the food industry.

If the rollers are made of harder, less porous materials which are sanitarily acceptable in the food industry, a problem is then encountered with being able to effectively grip and drive the flexible food containers between the rollers without slippage. In the past, squeeze rollers have been provided with knurled surfaces for increased friction. However, it has been found that if this type of roller is used to dispense food from flexible containers, slippage results. Additionally, knurled surfaces are much harder to keep clean.

SUMMARY OF THE INVENTION

With the foregoing in mind, it is a principal object of this invention to provide a food roller dispenser for effectively removing substantially the entire contents of flexible food containers.

Another object is to provide such a food dispenser utilizing rollers made of a relatively hard, non-porous material that is sanitarily acceptable for use in the food industry.

Still another object is to provide such a food dispenser utilizing rollers of the type described that positively grip and drive a flexible food container therebetween without slippage to effect squeezing of the food product from the food container.

Still another object is to provide such a food roller dispenser which may be easily disassembled and cleaned with the frequency required in the food industry.

These and other objects of the present invention may be achieved by providing a food roller dispenser with a pair of elongated rollers having a plurality of circumferentially spaced teeth around the outer periphery of the rollers which mesh together during rotation of the rollers to grip and drive flexible food containers upwardly between the rollers to thereby remove substantially all of the food product from the food containers passing therebetween. The rollers are desirably made of a relatively hard, non-porous one piece plastic material which is substantially solid throughout. Adjacent opposite ends of the roller teeth are roller bearing portions which are supported by bearing blocks that may be moved relative to each other to control the amount of overlap between the roller teeth. To reduce roller deflection, the outer diameter of the rollers between the ends of the roller bearing portions is relatively large. Also, both the roller bearing portions and bearing blocks in which the roller bearing portions are supported are desirably of substantial length.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
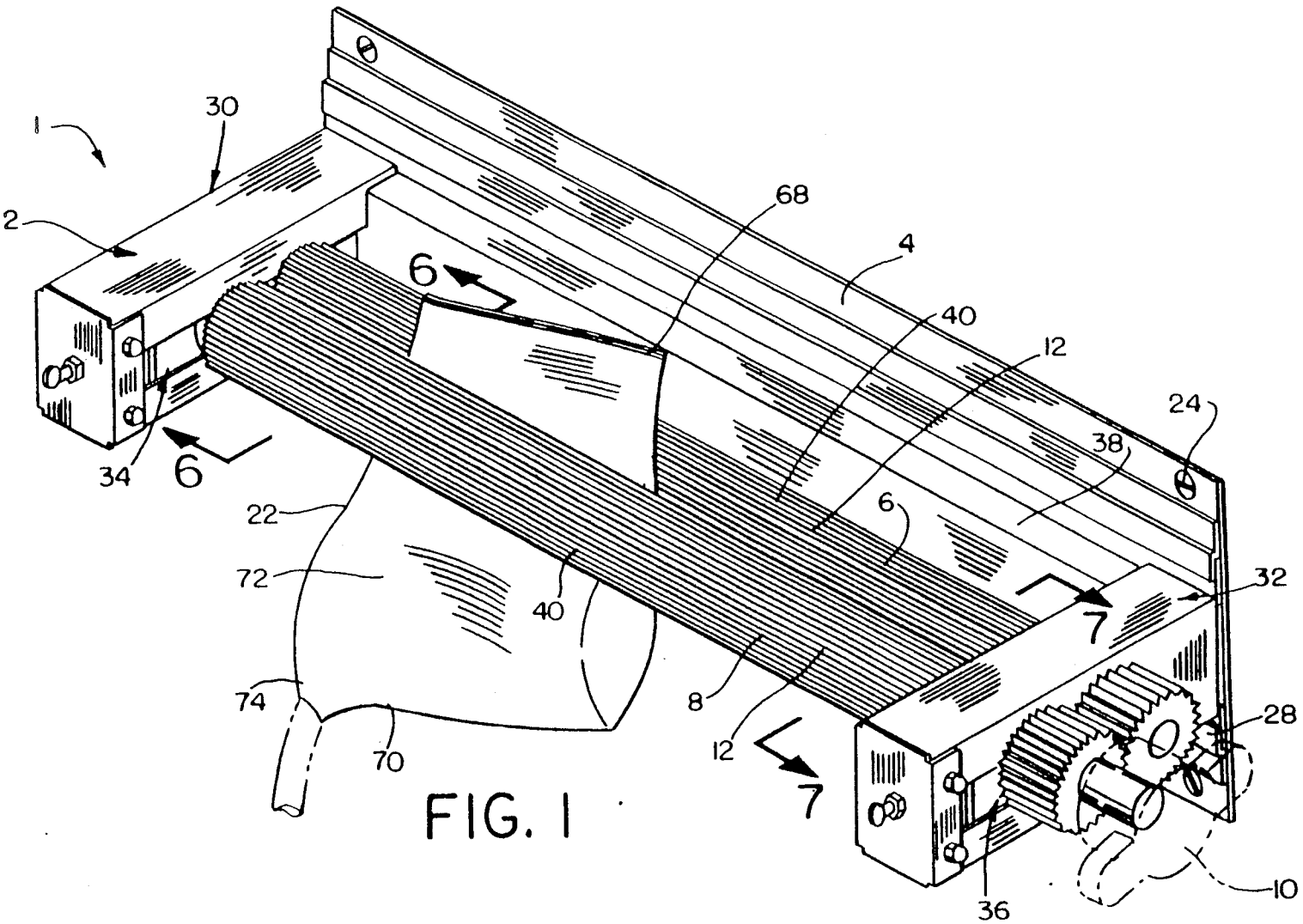
FIG. 1 is a perspective view of a preferred form of food roller dispenser in accordance with the present invention.

Referring now in detail to the drawings, and initially to FIG. 1, there is shown a preferred form of food roller dispenser 1 in accordance with this invention including a roller assembly 2 supported by a support bracket 4. Roller assembly 2 includes a pair of rollers 6 and 8 which may be counter rotated by operation of a hand crank 10 attached to one of the roller shafts as described hereafter. Preferably, both rollers 6, 8 are made of a single piece of relatively hard, nonporous plastic material such as acetal nylon which can easily be cleaned and is sanitarily acceptable for use in the food industry.

Figure 4:
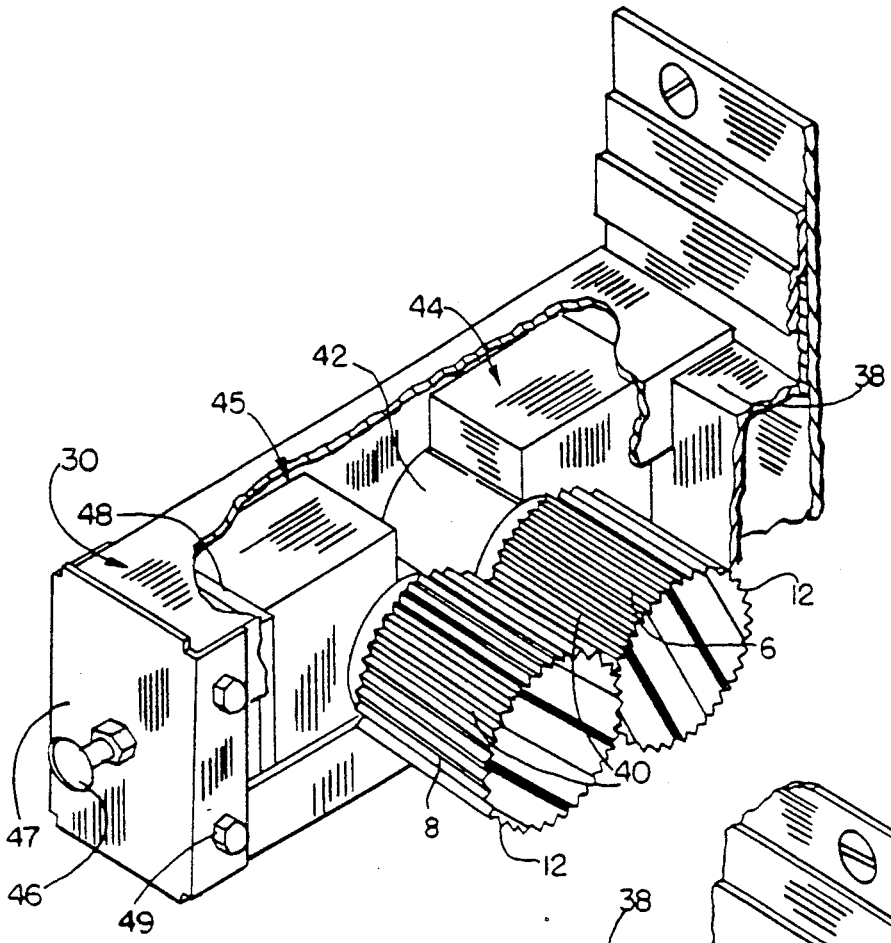
FIGS. 4 and 5 are enlarged fragmentary perspective views of opposite ends of the food roller dispenser of FIG. 1, with portions of the roller assembly housings broken away to show the bearing supports at opposite ends of the rollers.
Figure 5:
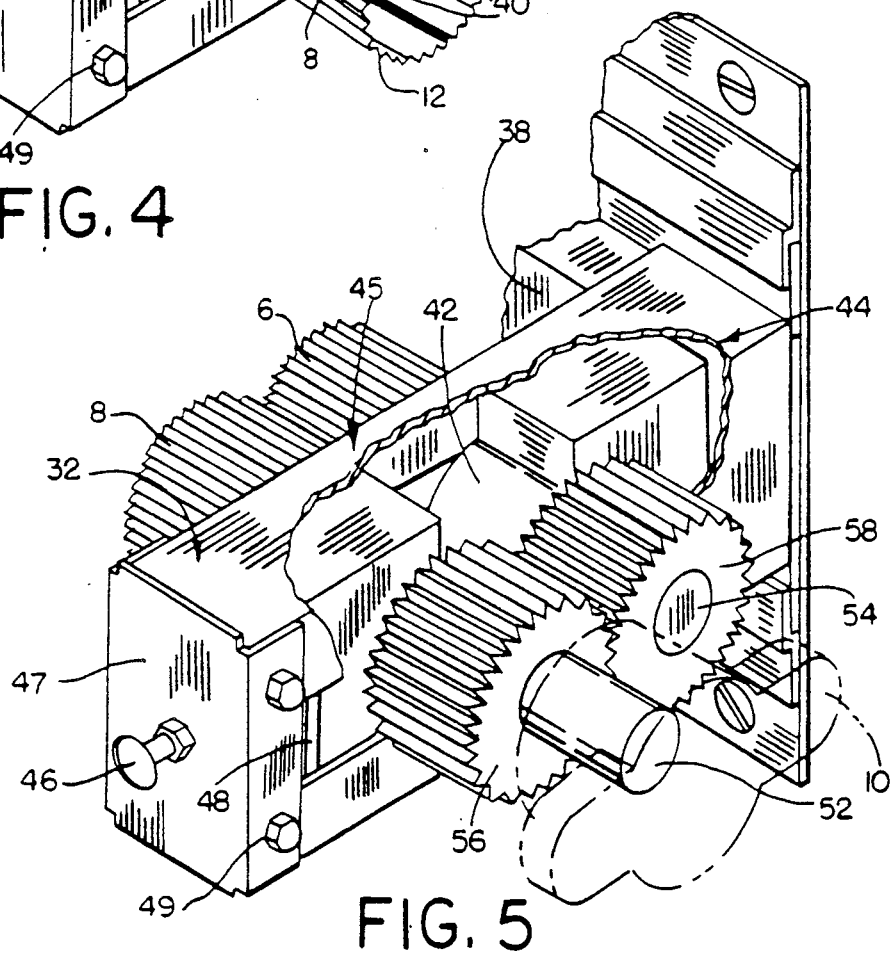
Figure 9:
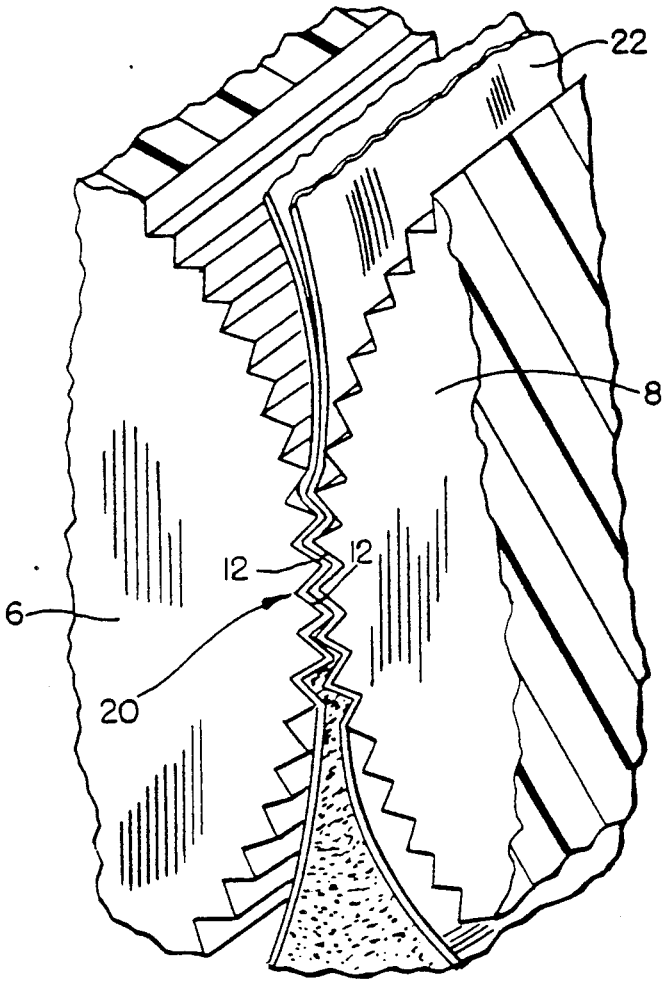
FIG. 9 is an enlarged schematic perspective view showing the manner in which the roller teeth mesh together to grip and squeeze out the contents of a flexible food container captured therebetween.

Referring further to FIG. 1 and also FIGS. 4, 5 and 9, it will be seen that both rollers 6, 8 are generally circular in cross section and have a plurality of external, longitudinally extending teeth 12 around their outer peripheries which are pressed into meshing engagement with each other as described hereafter. As best seen in FIG. 9, the teeth 12 are generally V-shaped and are configured to mate with each other as they come together in the area generally indicated by numeral 20. In this area, a flexible pouch-like food container 22 inserted between the rollers 6, 8 is positively and mechanically gripped by the teeth 12, whereby the container will be driven between the rollers as the rollers are counter-rotated to force the removal of the contents from the flexible container.

Figure 3:
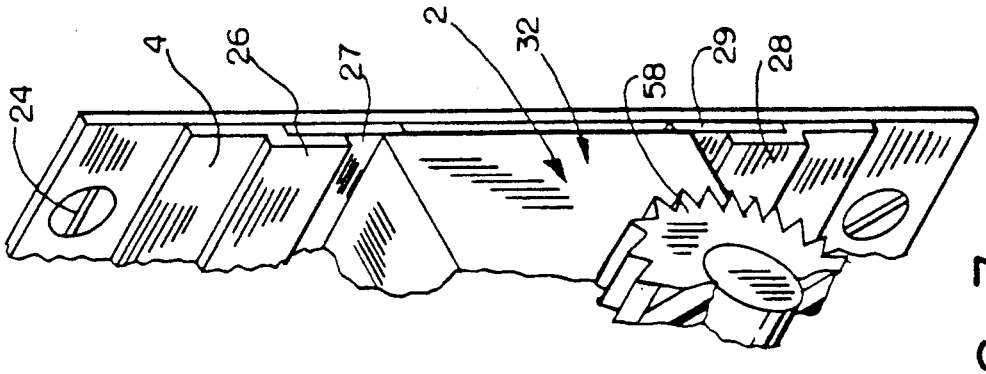
FIG. 3 is an enlarged fragmentary perspective view of the right end of the support bracket and roller assembly of FIG. 1.
Figure 2:
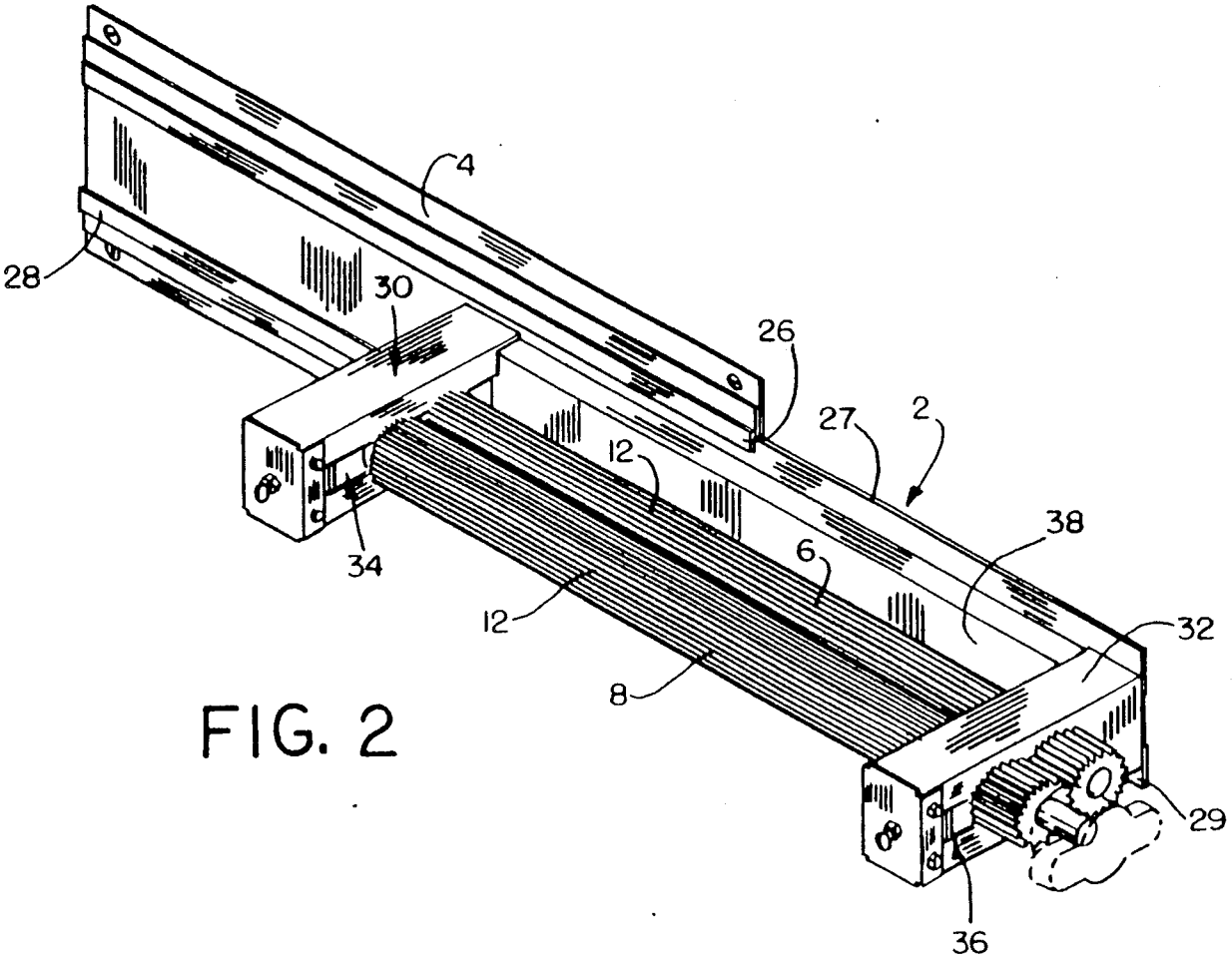
FIG. 2 is a perspective view of the food roller dispenser of FIG. 1, but on a reduced scale, and showing partial removal of the roller assembly from its support bracket.

With reference to FIGS. 2 and 3, it will be appreciated that the roller assembly 2 is designed for easy removal from the support bracket 4 to facilitate cleaning as is frequently necessary with food handling equipment. To that end, the support bracket 4 is desirably provided with a pair of vertically spaced apart, horizontally extending channels 26, 28 which slidingly receive flanges 27, 29 respectively protruding above and below a beam-like support member 38 of the roller assembly 2, thus enabling the roller assembly to be easily removed from the support bracket 4.

Figure 6:
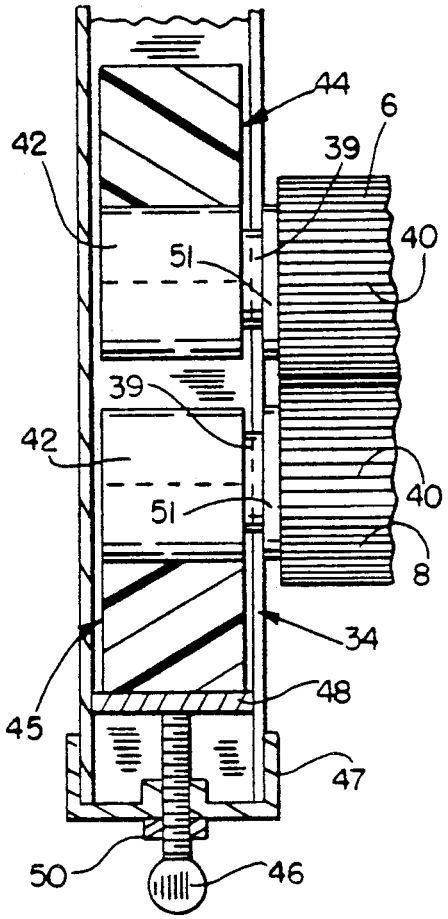
FIGS. 6 and 7 are enlarged fragmentary transverse sections through opposite ends of the food roller dispenser of FIG. 1, taken generally along the planes of the lines 6—6 and 7—7 thereof.
Figure 7:
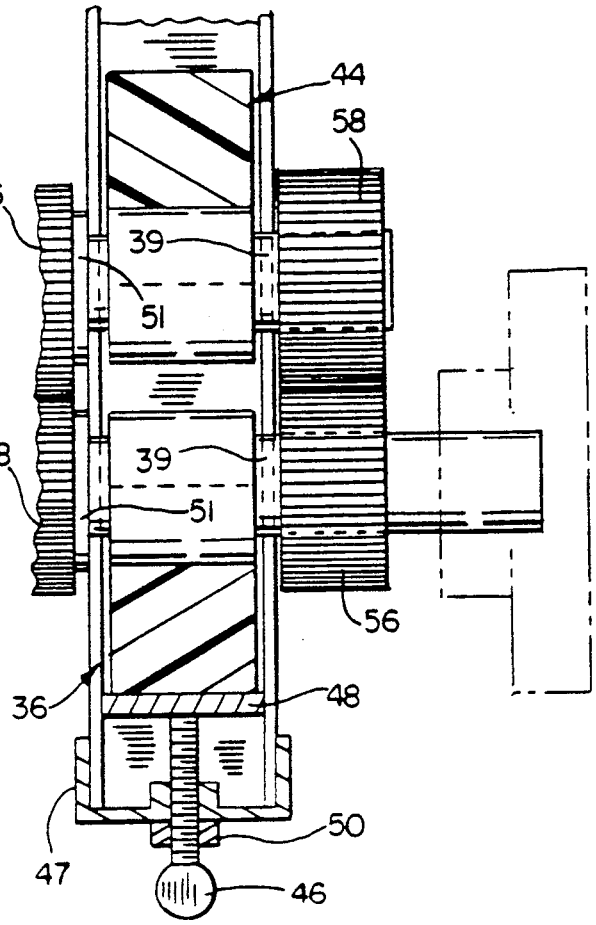
Figure 8:
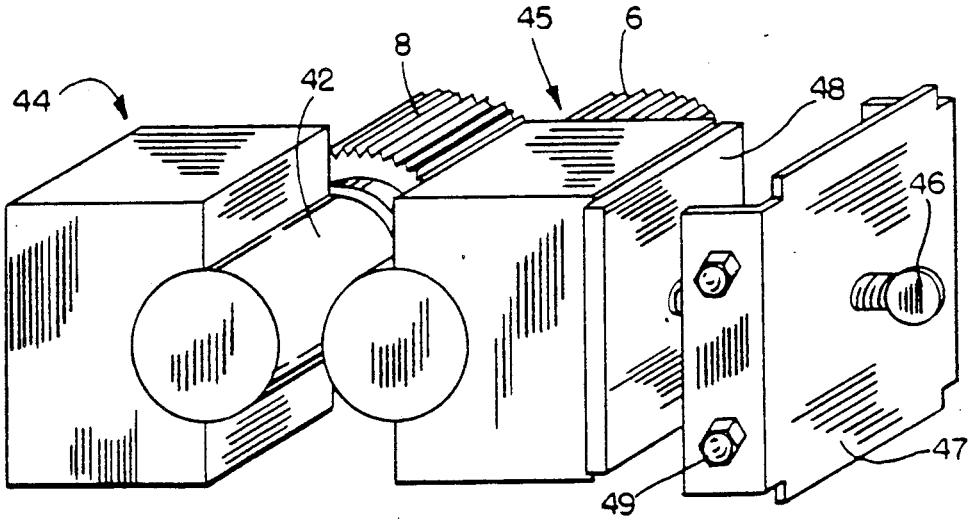
FIG. 8 is an enlarged schematic perspective view of the roller bearings and pillow block orientation at the left of the food roller dispenser of FIG. 1.

Once removed, the roller assembly 2 is easily disassembled so that its parts may be properly cleaned and sanitized. As can be seen in FIGS. 1 and 4–7, the roller assembly 2 includes a pair of hollow box-like beams 30, 32 extending forwardly outwardly from opposite ends of the support member 38. Beams 30, 32 are open at their outer ends and include longitudinal slots 34, 36 along one or both sides to permit reduced diameter portions 39 of the rollers 6, 8 adjacent opposite ends of the toothed roller portions 40 to be slid along the slots 34, 36 for locating roller bearing portions 42 within the beams. Each beam 30, 32 is also adapted to snugly and slidably receive a pair of bearing blocks 44, 45 for supporting the roller bearing portions 42. The bearing blocks 44, 45 are shown in FIGS. 6 and 7 as being made of plastic.

During assembly, a first bearing block 44 is inserted into each beam 30, 32 through the open outer ends thereof followed by insertion of the roller bearing portions 42 of both rollers 6, 8. Then another bearing block 45 is inserted so that both roller bearing portions 42 are supported on opposite ends by the bearing blocks 44, 45. Accordingly, when the outer bearing block 45 is forced toward the inner bearing block 44, the toothed roller portions 40 of the rollers 6, 8 will be forced into meshing engagement with each other. The extent of such meshing engagement can be controlled as by providing thumbscrews 46 in cover plates 47 which are used to close off the open outer ends of the beams 30, 32 during use of the dispenser.

The cover plates 47 may be removably attached to the outer ends of beams 30, 32 using suitable fasteners such as bolts having easily removable acorn nuts 49 or the like on the outer ends thereof. The thumbscrews 46 are threadedly received in openings in the end walls of the cover plates 47. When tightened, the thumbscrews 46 press against bearing plates 48 inserted within the respective beams outwardly of the outer bearing blocks 45 to exert an axial inward force against such outer bearing blocks (see FIGS. 6 and 7). A locknut 50 on each thumbscrew 46, when tightened, holds the thumbscrews 46 and thus the bearing blocks 44, 45 in their desired position exerting an appropriate amount of force on the roller bearing surfaces 42 to squeeze the toothed roller portions 40 together.

Although the dimensions of the roller bearing surfaces 42 may vary, they should have a sufficient outer diameter and length to provide adequate support for the rollers 6, 8 to resist bending. Likewise, the reduced diameter portions 39 between the roller bearing surfaces 42 and the toothed roller portions 40 should be relatively shallow in depth and just wide enough to accommodate the thickness of the wall of the slots 34, 36 received therein so as not to adversely affect the rigidity of the rollers. In a preferred form of the invention, the toothed portions 40 of the rollers 6, 8 may have a maximum outer diameter of approximately 1.375 inch, and the reduced diameter portions 39 may have an outer diameter of approximately 0.624 inch and a width of approximately 0.125 inch. Also, the roller bearing surfaces 42 may have an outer diameter of approximately 1.0 inch and an axial length of approximately 1.125 inch.

Likewise, the number and size of the roller teeth 12 may vary within certain limits. However, in a preferred embodiment wherein the toothed roller portions 40 have a maximum outer diameter of approximately 1.375 inches as aforesaid, approximately seventy-two teeth 12 are desirably provided around the outer periphery of the rollers at 5° increments, each approximately 0.030 inch deep and having an included angle of between approximately 40° and 80°.

With the roller dimensions as given, it is desirable to have the roller teeth 12 overlap a depth of approximately 0.025 inch where they come into full mating relationship. However, it will be appreciated that the amount of overlap between the teeth 12 may be varied to accommodate different types and thicknesses of food containers by adjusting the spacing between the bearing blocks 44, 45.

To reduce friction between the inside walls of the beams 30, 32 and the adjacent surfaces of the rollers 6, 8, a stepped shoulder 51 (FIGS. 6 and 7) is desirably provided at opposite ends of the toothed roller portions 40 having a width of approximately 0.125 inch and an outer diameter of approximately one inch, which substantially corresponds to the outer diameter of the roller bearing portions 42.

At one end of each roller 6, 8 is a reduced diameter shaft extension 52, 54 which extends outwardly beyond the associated beam 32 to provide for attachment of a driving gear 56 and hand crank 10 to one of the rollers 8 and a driven gear 58 to the other roller 6. The gears 56, 58, as well as the hand crank 10, may be suitably attached to the roller shaft extension 52, 54 as by means of set screws (not shown), and are in meshing engagement with each other, whereby rotation of the driving gear 56 and associated roller 8 in one direction will cause counter rotation of the driven gear 58 and associated roller 6.

To disassemble the entire roller assembly 2 for cleaning is a simple matter, it only being necessary to remove the fasteners 49, etc. that secure the cover plates 47 to the outer ends of the beams 30, 32. Once these plates 47 are removed, the bearing plates 48, bearing blocks 44, 45 and roller bearing portions 42 are easily slid out from within the respective beams 30, 32. After disassembly and cleaning, the roller assembly 2 is reassembled in reverse order to disassembly.

From the foregoing, it will be apparent that the food roller dispenser 1 of the present invention will effectively dispense food from flexible pouch-like food containers 22. In use, a top portion 68 of the container 22 is inserted between the toothed roller portions 40 from below and the hand crank 10 is turned counterclockwise as viewed in FIG. 1 to cause the toothed roller portions 40 to engage the top of the container. Next the bottom portion 70 of the container 22 is opened so that the contents 72 may be descharged as the container is advanced upwardly between the roller teeth 12 where they come together. Cooperation of the roller teeth 12 as well as the driving engagement between the roller gears 56, 58 cause the container 22 to be advanced and squeezed between the roller teeth during rotation of the handle 10 in the required direction so that the contents of the flexible food container is discharged through a discharge opening 74 in the bottom of the container.

Also from the foregoing it will be appreciated that the food roller dispenser 1 of the present invention is easily disassembled for ease of cleaning and the rollers 6, 8 are made of a relatively hard, non-porous material suitable for use in the food industry and intermesh to prevent slippage of even the most slippery of flexible food containers, thereby making the dispenser a very desirable "squeeze all" dispenser.

Although the invention had been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

What is claimed is:

1. A food roller dispenser for dispensing the contents of a flexible pouch-like container comprising a roller assembly including a pair of roller means having container engaging roller portions which drivingly grip said flexible pouch-like container to squeeze the contents from said container during counter-rotation of said roller means, support means for said roller means having a pair of hollow beams extending outwardly from one side of said support means in spaced apart relation, said beams having open outer ends for sliding receipt of a pair of spaced apart bearing blocks in each of said beams which support roller bearing portions on said roller means adjacent opposite ends of said roller means, and removable cover plate means for closing off said open outer ends of said beams, said cover plate means being removable to permit insertion and removal of said bearing blocks and said roller bearing portions from said beams for ease of cleaning, one of said bearing blocks of each pair being rigidly supported adjacent an inner end of said beams, and means for moving the other of said bearing blocks of each pair toward said one bearing block for exerting an axial force against said roller bearing portions positioned between said bearing blocks to vary the gripping force of said roller portions against said container passing therebetween, each of said roller means including said roller portions and said roller bearing portions being made of a single piece of a relatively hard, non-porous plastic material, each of said roller means including integral reduced diameter portions between said roller portions and said roller bearing portions which are slidably received in slots in the sides of said beams for locating said roller bearing portions within said beams.

2. The food roller dispenser of claim 1 wherein said reduced diameter portions of said roller means have an axial length just long enough to be slidably received in said slots.

3. The food roller dispenser of claim 2 wherein said roller bearing portions have an axial length substantially greater than the axial length of said reduced diameter portions.

4. The food roller dispenser of claim 3 wherein said roller bearing portions have an outer diameter substantially greater than the outer diameter of said reduced diameter portions and less than the outer diameter of said roller portions.

5. The food roller dispenser of claim 4 wherein said roller means have integral stepped shoulders at opposite ends of said roller portions, said stepped shoulders having an outer diameter substantially corresponding to the outer diameter of said roller bearing portions and having an axial length substantially corresponding to the axial length of said reduced diameter portions.

6. The food roller dispenser of claim 2 wherein each of said roller means have smaller diameter integral shaft extensions which extend through additional slots in said beams, and gears on said shaft extensions in mating engagement with each other, whereby rotation of one of said roller means causes counter-rotation of the other of said roller means.

7. The food roller dispenser of claim 2 wherein said roller portions have cooperating teeth which overlap each other during counter-rotation of said roller means to drivingly grip said flexible container between said roller portions and squeeze the contents from said container during movement of said container between said roller portions, said teeth being generally V-shape, and at approximately 5° increments around the periphery of said roller portions.

8. The food roller dispenser of claim 7 wherein said teeth overlap a depth of approximately 0.025 inch where said teeth come into full mating relationship.

9. The food roller dispenser of claim 6 wherein one of said shaft extensions extends outwardly beyond one of said gears for mounting of a handcrank on said one shaft extension for turning of said one shaft extension.

10. The food roller dispenser of claim 2 further comprising a support bracket for said roller assembly, said support bracket having a pair of vertically spaced apart, horizontally-extending channels for sliding receipt of flanges on said roller assembly for ease of removal and assembly of said roller assembly onto said support bracket.

11. A food roller dispenser for dispensing the contents of a flexible pouch-like container comprising a roller assembly including a pair of roller means having container engaging roller portions which drivingly grip said flexible pouch-like container to squeeze the contents from said container during counter-rotation of said roller means, support means for said roller means having a pair of hollow beams extending outwardly from one side of said support means in spaced apart relation, said beams having open outer ends for sliding receipt of a pair of spaced apart bearing blocks in each of said beams which support roller bearing portions on said roller means adjacent opposite ends of said roller means, and removable cover plate means for closing off said open outer ends of said beams, said cover plate means being removable to permit insertion and removal of said bearing blocks and said roller bearing portions from said beams for ease of cleaning, one of said bearing blocks of each pair being rigidly supported adjacent an inner end of said beams, and means for moving the other of said bearing blocks of each pair toward said one bearing block for exerting an axial force against said roller bearing portions positioned between said bearing blocks to vary the gripping force of said roller portions against said container passing therebetween, said bearing blocks being made of plastic, and said means for moving said other bearing block of each pair toward said one bearing block comprising bearing plates slidably received in said beams, said bearing plates being disposed axially outwardly of said other bearing blocks, and rotatable thumbscrew means extending through said cover means into engagement with said bearing plates for exerting an axial force against said bearing plates thus urging said other bearing blocks towards said one bearing blocks.

12. A food roller dispenser for dispensing the contents of a flexible pouch-like container comprising a roller assembly including a pair of roller means having container engaging roller portions which drivingly grip said flexible pouch-like container to squeeze the contents from said container during counter-rotation of said roller means, support means for said roller means having a pair of hollow beams extending outwardly from one side of said support means in spaced apart relation, said beams having open outer ends for sliding receipt of a pair of spaced apart bearing blocks in each of said beams which support roller bearing portions on said roller means adjacent opposite ends of said roller means, and removable cover plate means for closing off said open outer ends of said beams, said cover plate means being removable to permit insertion and removal of said bearing blocks and said roller bearing portions from said beams for ease of cleaning, one of said bearing blocks of each pair being rigidly supported adjacent an inner end of said beams, and means for moving the other of said bearing blocks of each pair toward said one bearing block for exerting an axial force against said roller bearing portions positioned between said bearing blocks to vary the gripping force of said roller portions against said container passing therebetween, each of said roller means including said roller portions and said roller bearing portions being made of a single piece of a relatively hard, non-porous plastic material.

* * * * *